US007575376B2

(12) United States Patent
Yu

(10) Patent No.: US 7,575,376 B2
(45) Date of Patent: Aug. 18, 2009

(54) COLLAPSIBLE BAG

(75) Inventor: Chris Yu, Carson, CA (US)

(73) Assignee: Luggage America, Inc., Carson, CA (US)

( * ) Notice: Subject to any disclaimer, the term of this patent is extended or adjusted under 35 U.S.C. 154(b) by 561 days.

(21) Appl. No.: 10/907,132

(22) Filed: Mar. 22, 2005

(65) Prior Publication Data

US 2006/0215938 A1 Sep. 28, 2006

(51) Int. Cl.

| | |
|---|---|
| ***B65D 30/00*** | (2006.01) |
| ***B65D 33/10*** | (2006.01) |
| ***B65D 33/16*** | (2006.01) |
| ***B65D 33/00*** | (2006.01) |
| ***A45C 15/00*** | (2006.01) |
| ***A45C 7/00*** | (2006.01) |
| ***A45F 4/00*** | (2006.01) |

(52) U.S. Cl. ..... 383/2; 383/8; 383/61.3; 383/97; 224/575; 224/581; 190/103

(58) Field of Classification Search ..... 383/2, 383/4, 61.3, 97; 224/581, 577, 575; 190/103, 190/104, 105

See application file for complete search history.

(56) References Cited

U.S. PATENT DOCUMENTS

| | | | | | |
|---|---|---|---|---|---|
| 3,443,671 | A | * | 5/1969 | Dyke | 190/103 |
| D231,042 | S | * | 3/1974 | Lee | D3/289 |
| 4,334,601 | A | * | 6/1982 | Davis | 224/148.3 |
| 4,361,215 | A | * | 11/1982 | Sawai | 190/18 A |
| D280,362 | S | * | 9/1985 | Allen | D3/286 |
| D284,425 | S | * | 7/1986 | Allen | D3/287 |
| 4,773,515 | A | * | 9/1988 | Kotkins, Jr. | 190/103 |
| 4,805,748 | A | | 2/1989 | Gerch | |
| 4,862,520 | A | | 9/1989 | Gazzola | |
| 4,984,906 | A | * | 1/1991 | Little | 383/4 |
| 5,042,664 | A | * | 8/1991 | Shyr et al. | 206/579 |
| 5,047,001 | A | | 9/1991 | Willis | |
| 5,105,919 | A | | 4/1992 | Bomes | |
| 5,119,519 | A | * | 6/1992 | Foreman | 5/640 |
| 5,316,388 | A | | 5/1994 | Caligiuri | |
| 5,425,449 | A | | 6/1995 | Boorady | |
| 5,787,504 | A | | 8/1998 | Wu | |
| 5,881,932 | A | | 3/1999 | Wadden | |
| 6,053,634 | A | | 4/2000 | Kay | |
| 6,568,852 | B1 | * | 5/2003 | Godshaw et al. | 383/2 |
| 2002/0153216 | A1 | * | 10/2002 | Krulik | 190/103 |
| 2007/0164064 | A1 | * | 7/2007 | Nathan | 224/153 |

* cited by examiner

*Primary Examiner*—Jes F Pascua
(74) *Attorney, Agent, or Firm*—Lee, Hong, Degerman, Kang & Waimey

(57) ABSTRACT

An apparatus is capable of collapsing into a smaller configuration is disclosed. The apparatus comprises a first sidewall and a second sidewall interconnected by a bottom wall, a front wall, a rear wall, and a top wall to form a collapsible bag. A first zipper track is disposed into the bottom wall connecting between a portion of the bottom wall and a first position. A second zipper track is disposed into the bottom wall opposite to the first zipper track. The second zipper track is located between the portion of the bottom wall and a second position. A zipper slider is provided for connecting together the first zipper track and the second zipper track for coupling of the first zipper track and the second zipper track along the contour of the collapsible bag.

19 Claims, 5 Drawing Sheets

COLLAPSIBLE BAG

BACKGROUND OF THE INVENTION

1. Field of the Invention

The present invention relates to a collapsible bag for carrying articles. More particularly, the invention relates to a bag that collapses into a smaller configuration.

2. Description of the Related Art

There are a variety of bags that are convertible from one configuration to another. These bags are made from materials such as nylon or cloth. For example, there are related art bags that convert from a briefcase configuration to a backpack configuration. However, related art convertible bags suffer many drawbacks. For example, when the related art bags are converted to a smaller configuration, handles may be exposed from a previous configuration. These handles may dangle, become entangled, and cause inconvenience to a user carrying the converted bag. One related art convertible bag by including a reel-like device to withdraw the handles inside the bag. The reel-like device, however, increases bag costs and prevents a larger-sized bag, upon conversion, from achieving a smaller volume than would be possible without the reel-like device.

In another example, a relatively small related art bag, such as a lunch bag or a shopping bag, may be inwardly folded for conversion into a smaller configuration for storage into a pouch. However, if a larger related art convertible bag is folded, a user may find the converted bag bulky and have great difficultly carrying the bag upon conversion into the smaller configuration.

Related art convertible bags may use a mechanical device, such as a zipper, to achieve a bag having at least two configurations. In one configuration, the related art bag is un-zipped and unfolded to realize a larger surface area bag. In another configuration, the related art bag is zipped to convert the bag to a smaller surface area configuration. Other zipper related art bags provide multiple compartments, such as form fitting slots or pockets, for storing articles of various shapes and sizes. However, the related art bags using the zipper are bulky, even upon conversion to a smaller size. Accordingly, a user is inconvenienced when transporting bag.

Thus, there is a need for an improved apparatus and method for converting a bag from one configuration to another configuration to increase a user's ability for transporting the bag, decrease storage volume occupied by the bag upon conversion into a smaller configuration, and provide other advantages over related art convertible bags.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In one embodiment, an apparatus is disclosed for carrying articles that is collapsible into a smaller configuration. The apparatus comprises a first sidewall and a second sidewall interconnected by a bottom wall, a front wall, a rear wall, and a top wall to form a collapsible bag. A first zipper track is disposed in the bottom wall connecting between a portion of the bottom wall and a first position. The first position is proximally located between the first sidewall and the top wall. The first zipper track continues to extend from the first position along a contour of the collapsible bag along the top wall, the front wall, the bottom wall, the rear wall and back to the top wall.

A second zipper track is disposed in the bottom wall opposite to the first zipper track. The second zipper track is located between the portion of the bottom wall and a second position. The second position is proximally located between the second sidewall and the top wall. The second zipper track continues to extend from the second position along the contour of the collapsible bag along the top wall, the front wall, the bottom wall, the rear wall and back to the top wall.

A zipper slider is connected between the first zipper track and the second zipper track for coupling the first zipper track and the second zipper track along the contour of the collapsible bag to facilitate concealing the bottom wall, the front wall, the top wall, and the rear wall from the viewing of a user.

The apparatus has the first sidewall, the second sidewall, the first zipper track, the second zipper track, and the zipper slider exposed for viewing by the user when the first zipper track is coupled to the second zipper track by the zipper slider.

A first handle for carrying the bag in the first configuration may be coupled from to a first end at the first sidewall and to a second end at the second sidewall. The coupling preferably occurs outside of the first zipper track and the second zipper track and is exposed to a user.

Additional features and advantages of the invention will be set forth in the description which follows, and in part will be apparent from the description, or may be learned by practice of the invention. It is to be understood that both the foregoing general description and the following detailed description of the present invention are exemplary and explanatory and are intended to provide further explanation of the invention as claimed.

These and other embodiments will also become readily apparent to those skilled in the art from the following detailed description of the embodiments having reference to the attached figures, the invention not being limited to any particular embodiments disclosed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

The present invention relates to creating a collapsible bag for carrying articles. More particularly, the invention relates to a bag that collapses from a first configuration to a second configuration having a smaller volume.

Although the invention is illustrated with respect to a collapsible bag, it is contemplated that the invention may be utilized wherever there is a desire for efficiently compacting containers used for transporting articles, such as consumer products, personal products, or groceries, from one location to another while minimizing the volume that the container occupies upon completing the transporting the articles. Reference will now be made in detail to the preferred embodiments of the present invention, examples of which are illustrated in the accompanying drawings.

Figure 1:
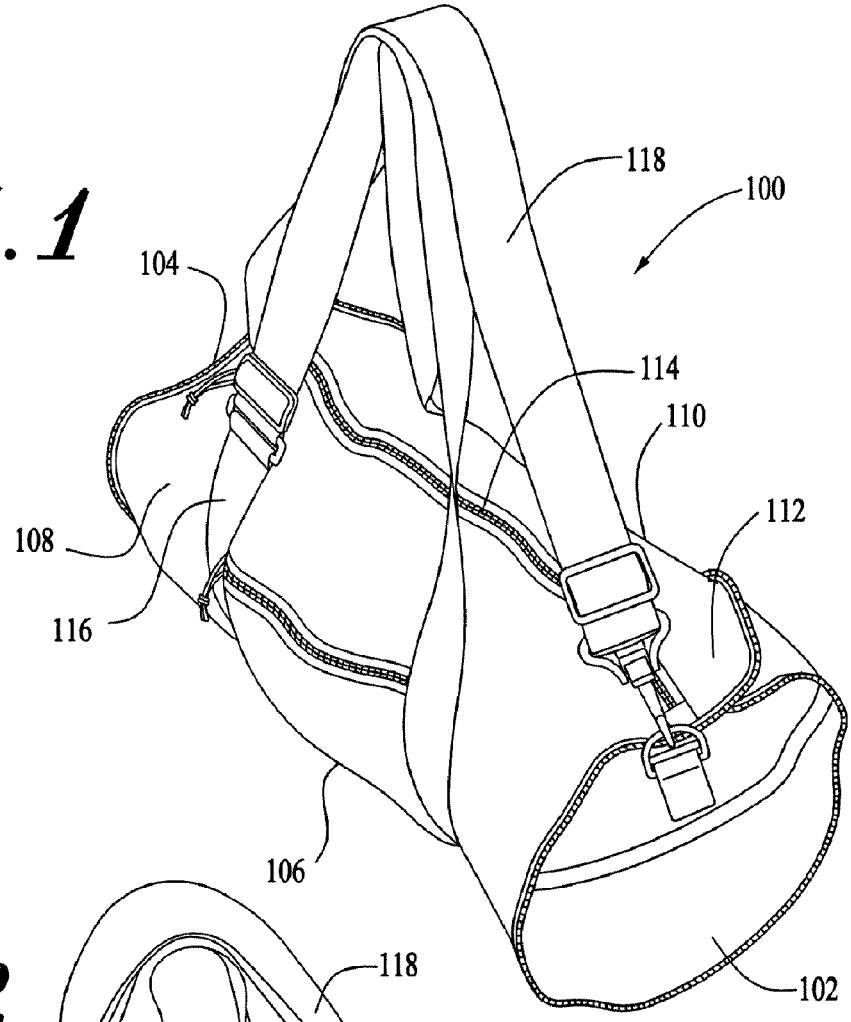
FIG. 1 illustrates a perspective view of a front wall for a collapsible bag, in a first configuration, in accordance with one embodiment of the present invention.

FIG. 1 illustrates a perspective view of a collapsible bag in a first configuration in accordance with one embodiment of the present invention.

Referring to FIG. 1, the collapsible bag 100 comprises a first sidewall 102 and a second sidewall 104 interconnected by a bottom wall 106, a front wall 108, a rear wall 110, and a top wall 112. The user, for example, may hold a first handle 118, which proximally connects to a first end at the first sidewall 102 and to a second end at the second sidewall 104. The first handle 118 preferably connects between an outer surface of the first sidewall 102 and an outer surface of the second sidewall 104. A user may hold a second handle 116 connected preferably to the bottom wall 106 for transporting the collapsible bag 100. As shown in FIG. 1, the collapsible bag 100 is in the first configuration, having the greatest capacity for holding articles, such as consumer products, personal items, or goods, such as groceries.

Figure 2:
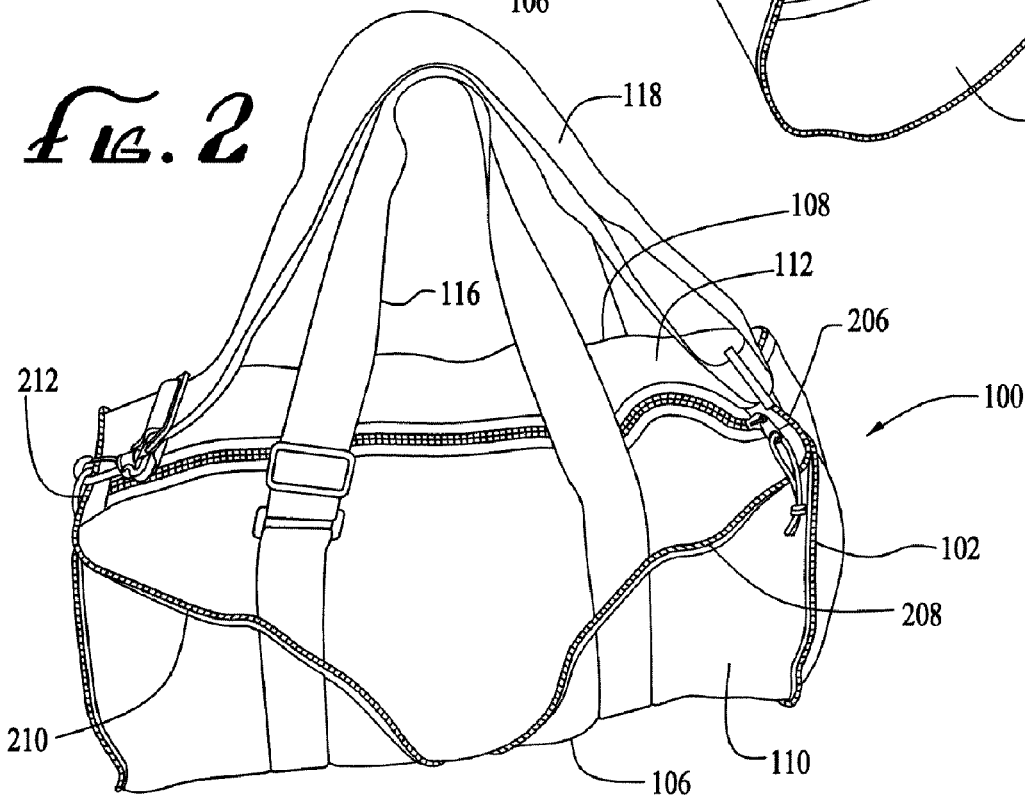
FIG. 2 illustrates a rear view of the collapsible bag depicting a first zipper track and a second zipper track in accordance with one embodiment of the present invention.
Figure 3:
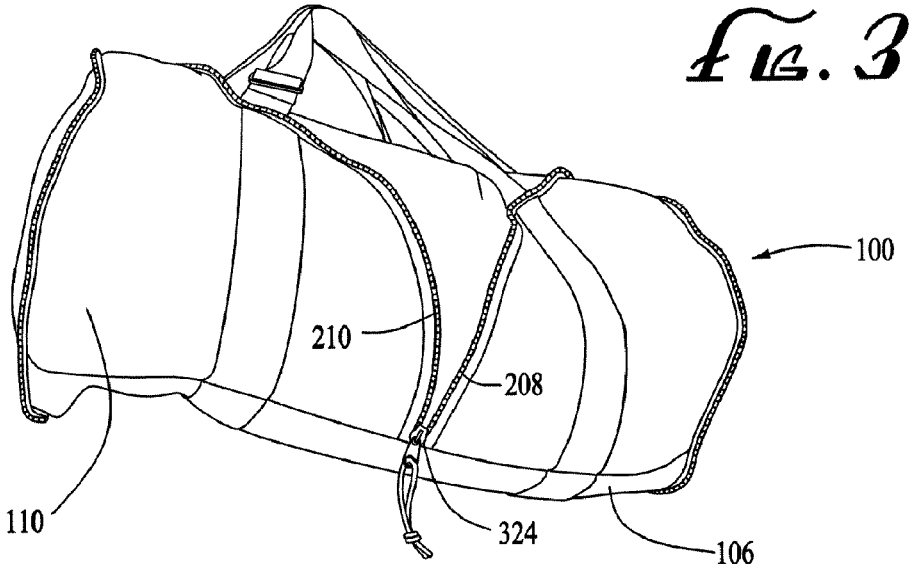
FIG. 3 illustrates a perspective view of a rear wall of the collapsible bag in accordance with one embodiment of the present invention.

FIG. 2 illustrates a rear view of the collapsible bag depicting a first zipper track and a second zipper track in accordance with one embodiment of the present invention. FIG. 3 illustrates a perspective view of the rear wall of the collapsible bag in accordance with one embodiment of the present invention.

Referring to FIGS. 2 and 3, a first zipper track 208 is integrated into the collapsible bag 100. The first zipper track 208 is connected between a portion of the bottom wall 324 and a first position 206. The portion of the bottom wall 324 preferably is a center position along the bottom wall 106. The first position 206 is connected preferably along an intersection of the first sidewall 102 and the top wall 112. The first position 206 more preferably is connected between an intersection of the first sidewall 102, the top wall 112, and the rear wall 110. The first zipper track 208 preferably provides a substantially diagonal connection path between the portion of the bottom wall 324 and the first position 206. The first zipper track 208 continues to extend from the first position 206 along a contour of the collapsible bag over the top wall 112, the front wall 108, the bottom wall 106, the rear wall 110, and back to the top wall 112.

A second zipper track 210 is integrated into the collapsible bag 100. The second zipper track 210 is located opposite to the first zipper track 208. The second zipper track 210 is connected between the portion of the bottom wall 324 and a second position 212. The second position 212 is preferably proximal to an intersection between the second sidewall 104 and the top wall 112. The second zipper track 210 continues to extend from the second position 212 along a contour of the collapsible bag over the top wall 112, the front wall 108, the bottom wall 106, the rear wall 110, and back to the top wall 112. The second zipper track 208 preferably provides a substantially diagonal connection path between the portion of the bottom wall 324 and the second position 212.

Figure 4:
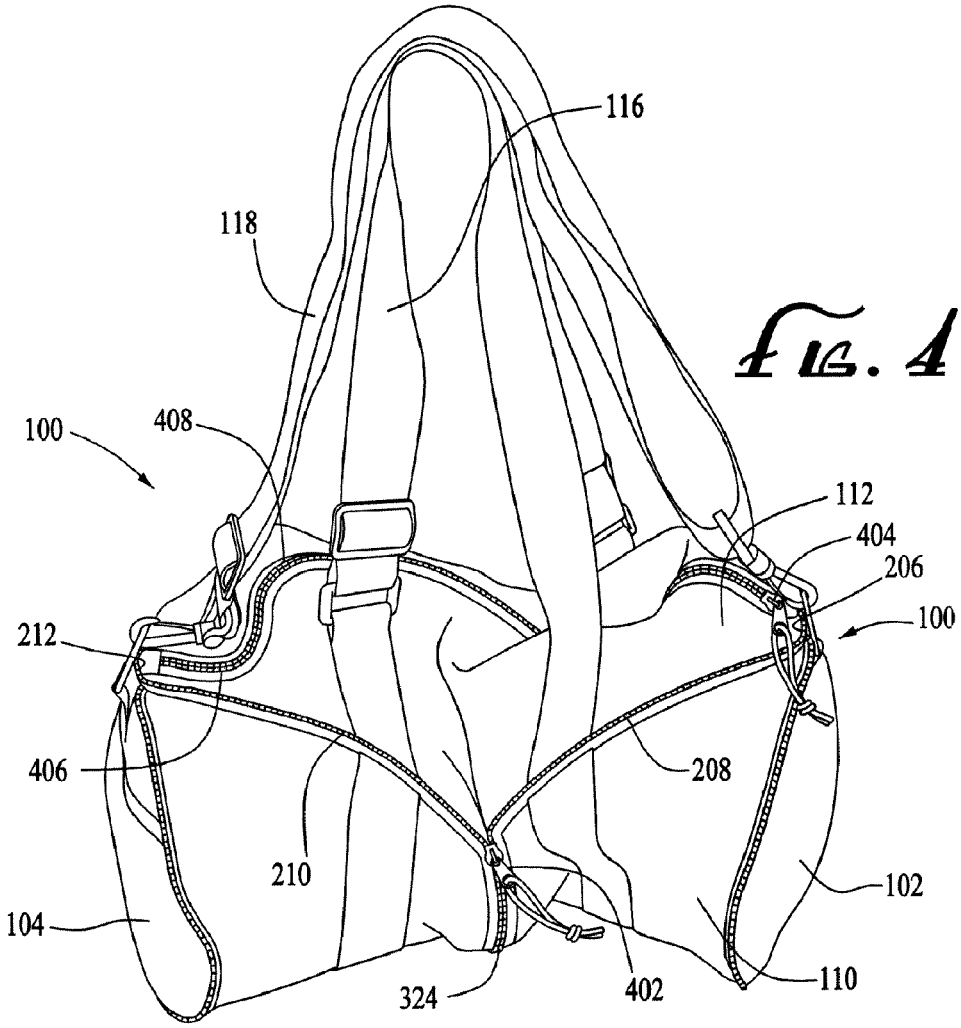
FIG. 4 illustrates a rear view of the collapsible bag while being zipped from a bottom portion of the bag toward a first sidewall and a second sidewall in accordance with one embodiment of the present invention.

FIG. 4 illustrates a rear view of the collapsible bag while being zipped from a bottom portion of the bag toward a first sidewall and a second sidewall in accordance with one embodiment of the present invention.

Referring to FIG. 4, a zipper slider 402 connects the first zipper track 208 and the second zipper track 210. The zipper slider 402 slides along the first zipper track 208 and the second zipper track 210 from the portion of the bottom wall 324 toward the first position 206 and the second position 212. A third zipper track 406 and a fourth zipper track 408, preferably integrated into the collapsible bag, are oppositely connected along the top wall 112. The third zipper track 406 and the fourth zipper track 408 extend proximally from the first sidewall 102 to the second sidewall 104 along the top wall 112. A top zipper slider 404 slidably connects the third zipper track 406 and the fourth zipper track 408.

Figure 5:
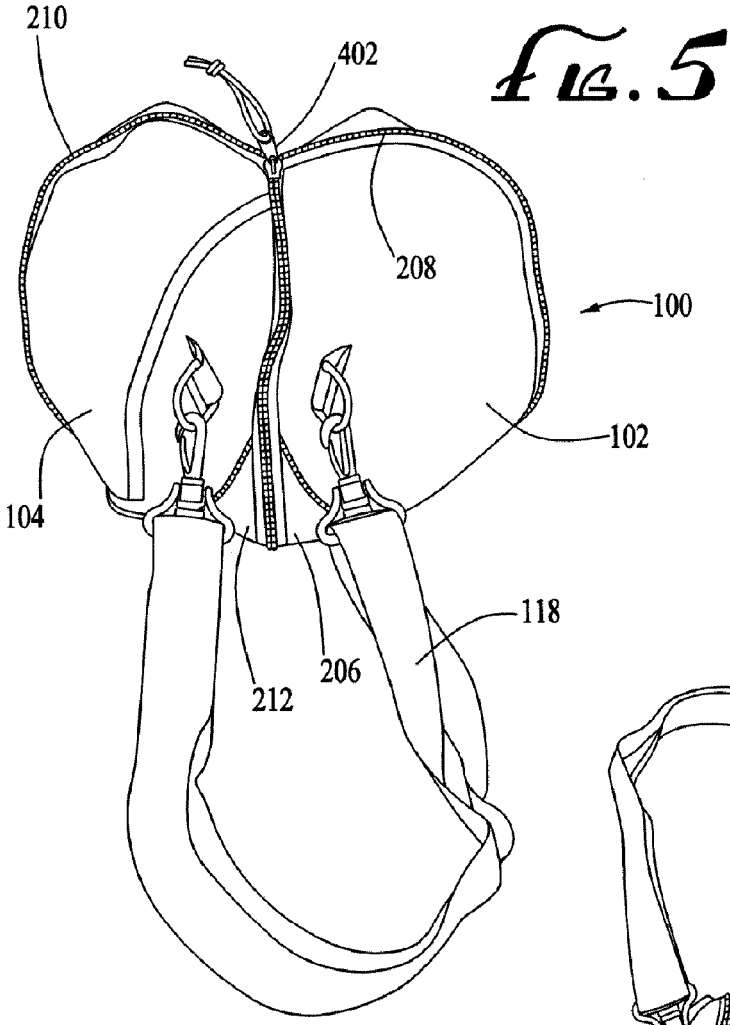
FIG. 5 illustrates a top view of the collapsible bag where the first sidewall and the second sidewall are partially zipped-up in accordance with one embodiment of the present invention.

FIG. 5 illustrates a top view of the collapsible bag where the first sidewall and the second sidewall are partially zipped-up in accordance with one embodiment of the present invention.

Referring to FIG. 5, the zipper slider 402 connects the first sidewall 102 and the second sidewall 104. The zipper slider 402 travels from the first position 206 and the second position 212 to connect the first zipper track 208 and the second zipper track 210 along the contour of the collapsible bag 100 over the front wall 108 to the bottom wall 106. The first handle 118 remains accessible to a user, in FIG. 5, for transporting the convertible bag 100. The second handle 116, however, is hidden from the view of the user.

Figure 6:
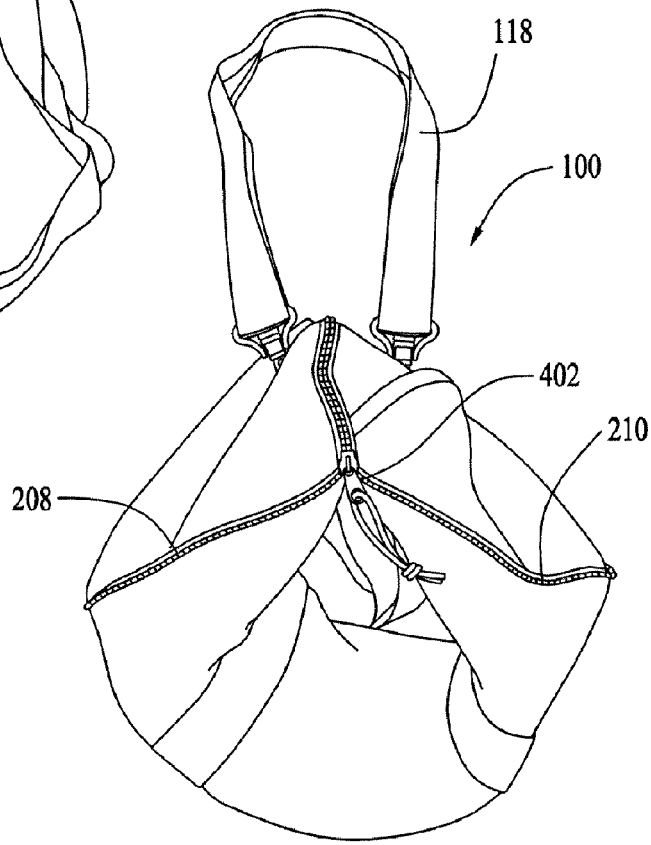
FIG. 6 illustrates a front view of the collapsible bag as the zipper slider is slid across the first sidewall and the second sidewall in accordance with one embodiment of the present invention.

FIG. 6 illustrates a front view of the collapsible bag as the zipper slider is slid across the first sidewall and the second sidewall in accordance with one embodiment of the present invention.

Referring to FIG. 6, the zipper slider 402 continues connecting the first zipper track 208 to the second zipper track 210 to couple the first sidewall 102 and the second sidewall 104.

Figure 8:
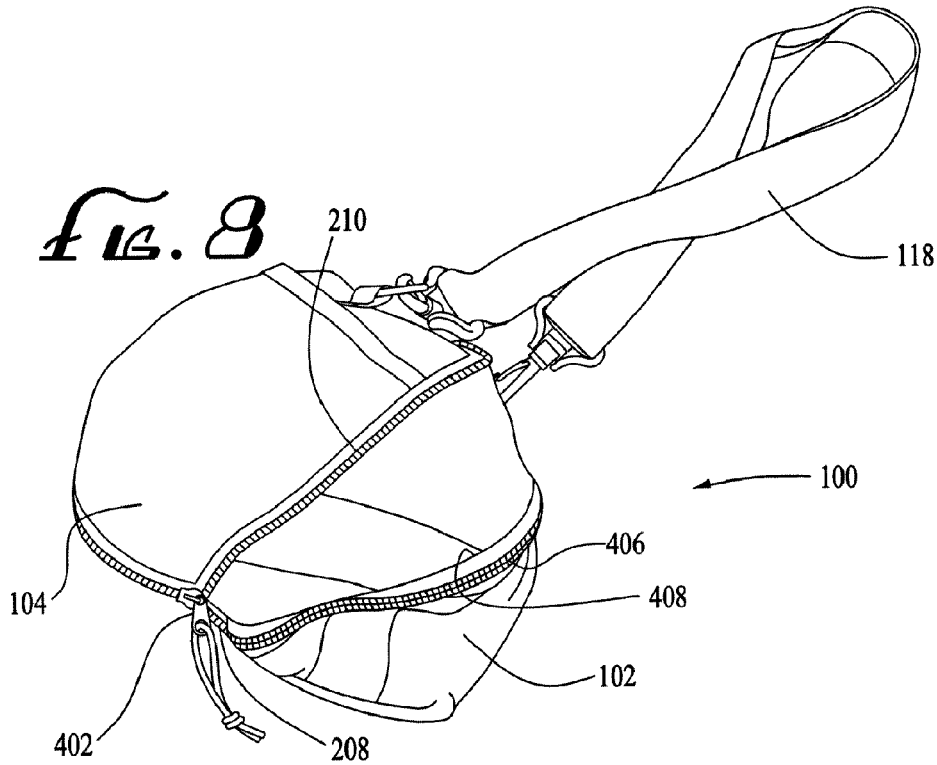
FIG. 8 illustrates a perspective view of the collapsible bag before being completely unzipped across the first and the second sidewalls in accordance with one embodiment of the present invention.
Figure 7:
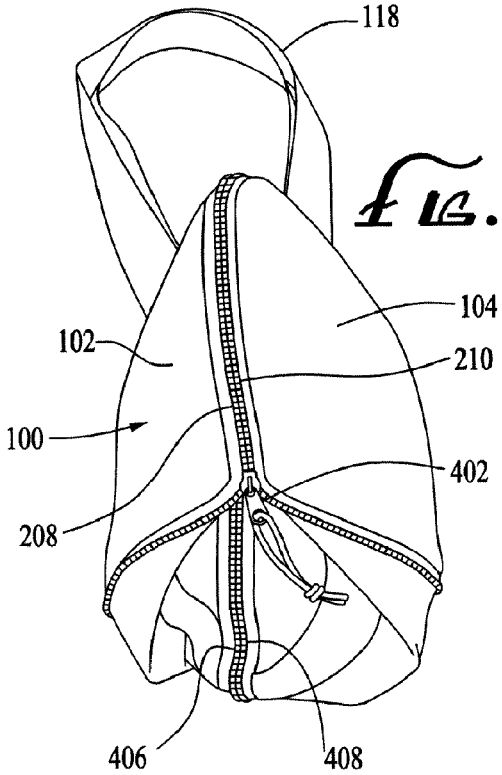
FIG. 7 illustrates a perspective view of the collapsible bag zipped across the front wall in accordance with one embodiment of the present invention.

FIG. 7 illustrates a perspective view of the collapsible bag after the first sidewall and the second sidewall are zipped across the rear wall in accordance with one embodiment of the present invention. FIG. 8 illustrates a perspective view of the collapsible bag before completion of zipping across the first sidewall and the second sidewalls in accordance with one embodiment of the present invention.

Referring to FIGS. 7 and 8, the zipper slider 402 continues traveling connecting the first zipper track 208 and the second zipper track 210 along the contour of the collapsible bag 100. As the zipper slider 402 is zipped, the third zipper track 406 and fourth zipper track 408 become contained within the collapsible bag 100 along with the second handle 116.

Figure 9:
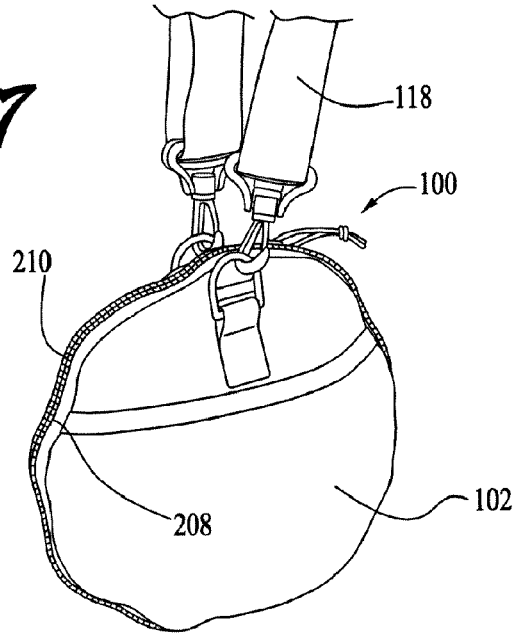
FIG. 9 illustrates a side view of the collapsible bag upon conversion to a second configuration in accordance with one embodiment of the present invention.

FIG. 9 illustrates a side view of the collapsible bag upon conversion to a second configuration in accordance with one embodiment of the present invention.

Referring to FIG. 9, the zipper slider 402 has completed traveling along the contour of the collapsible bag 100 to facilitate converting the collapsible bag 100 to a second configuration. The second configuration conceals from a user's view all of the following bag features, shown in FIG. 2, including: the bottom wall 106, the front wall 108, the top wall 112, and the rear wall 106. In the second configuration, the first sidewall 102, the second sidewall 104, the first zipper track 208, the second zipper track 210, the zipper slider 402, and the first handle 118 are accessible to a user. The second configuration, in this example, occupies a significantly smaller volume and surface area compared to the first configuration shown in FIG. 1.

Figure 10:
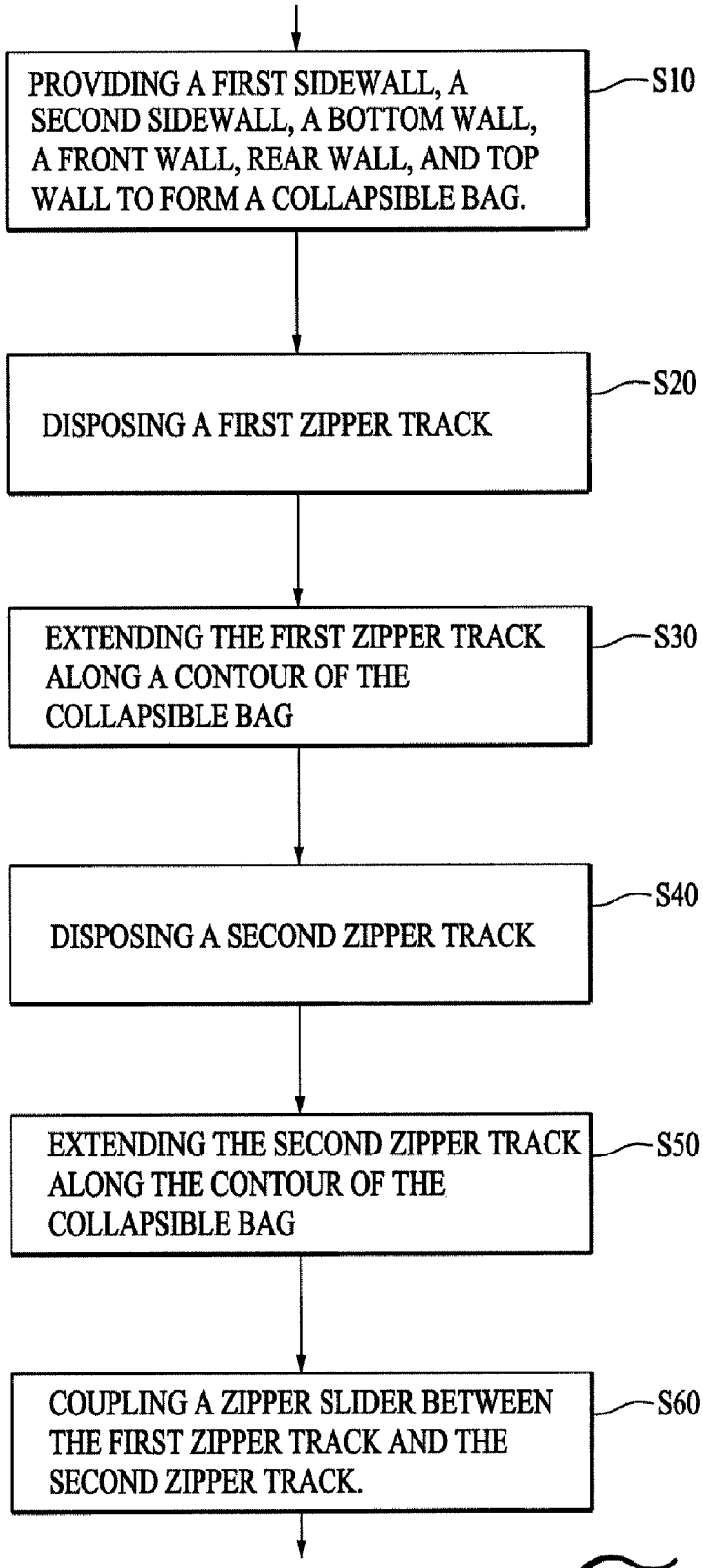
FIG. 10 illustrates a method for creating a collapsible bag in accordance with one embodiment of the present invention.

FIG. 10 illustrates a method for creating a collapsible bag in accordance with one embodiment of the present invention.

Referring to FIG. 10, a method is disclosed for forming a collapsible bag that converts from a larger configuration to a smaller configuration. The method comprises providing a first sidewall and a second sidewall interconnected by a bottom wall, a front wall, a rear wall, and a top wall (S10). The method further comprises disposing a first zipper track into the bottom wall for connecting a portion of the bottom wall to a first position, wherein the first position is proximally located between the first sidewall and the top wall (S20). The first zipper track continues to extend from the first position along a contour of the collapsible bag along the front wall, the bottom wall, and back to the top wall, preferably, along the rear wall (S30).

The method further comprises disposing a second zipper track into the bottom wall opposite to the first zipper track. The second zipper track is located between the portion of the bottom wall and a second position. The second position is proximally located between the second sidewall and the top wall (S40), wherein the second zipper track continues to extend from the second position along the contour of the collapsible bag along the front wall, the bottom wall, and back to the top wall preferably along the rear wall (S50).

A zipper slider may be provided between the first zipper track and the second zipper track for coupling the first zipper track and the second zipper track along the contour of the collapsible bag to facilitate concealing the bottom wall, the front wall, the top wall, and the rear wall from the view of a user (S60).

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

For example, the first and the second zipper tracks, and the zipper slider described above may be equivalently replaced using hook-and-loop fasteners, hooks, coupling fasteners, latches, or other similar connection type apparatuses.

What is claimed is:

1. An apparatus for carrying articles capable of collapsing into a smaller configuration, the apparatus comprising:

a first sidewall and a second sidewall interconnected by a bottom wall, a front wall, a rear wall, and a top wall to form a collapsible bag, the top wall providing an opening to store articles and the opening concealed in the smaller configuration;

a first zipper track substantially disposed on the rear wall and diagonally extending toward the first side wall, connecting between a point of the bottom wall, which is located at a center position along the bottom wall, and a first position, the first position proximally located between the first sidewall and the top wall, wherein the first zipper track continues to extend from the first position along a contour of the collapsible bag along the top wall, the front wall, the bottom wall, the rear wall and back to the top wall; and a second zipper track substantially disposed on the rear wall opposite to the first zipper track and diagonally extending toward the second side wall, connecting between the point of the bottom wall and a second position, the second position proximally located between the second sidewall and the top wall, wherein the second zipper track continues to extend from the second position along the contour of the collapsible bag along the top wall, the front wall, the bottom wall, the rear wall and returns to the top wall, wherein the first zipper track and the second zipper track extend from the same point of the bottom wall.

2. The apparatus of claim 1, further comprising:

a zipper slider connected between the first zipper track and the second zipper track for coupling the first zipper track and the second zipper track along the contour of the collapsible bag to facilitate concealing entire surfaces of the bottom wall, the front wall, the top wall, and the rear wall from the view of a user while the first side wall, the second sidewall, the first zipper track, the second zipper track, and the zipper slider are exposed for viewing by the user when the first zipper track is coupled to the second zipper track by the zipper slider.

3. The apparatus of claim 2, wherein the bottom wall, the front wall, the top wall, and the rear wall are completely enclosed by the first sidewall, the second sidewall, the first zipper track, the second zipper track, and the zipper slider that are exposed for viewing by the user when the first zipper track is completely coupled to the second zipper track by the zipper slider.

4. The apparatus of claim 1, further comprising a first handle coupled to a first end at the first sidewall and a second end at the second sidewall.

5. The apparatus of claim 4, wherein the first handle is coupled outside of the first zipper track and the second zipper track.

6. The apparatus of claim 5, wherein the first handle is exposed for viewing by a user.

7. The apparatus of claim 1, further comprising a third zipper track and a fourth zipper track oppositely connected along the top wall, the third zipper track and the fourth zipper track extending proximally between the first position and the second position providing the opening.

8. The apparatus of claim 7, wherein the third zipper track and the fourth zipper track are concealed when the first zipper track and the second zipper track are coupled along the contour of the collapsible bag to facilitate concealing the bottom wall, the front wall, the top wall, and the rear wall from the view of a user.

9. The apparatus of claim 7, further comprising a second handle having a first end and a second end, the first end connected to the bottom wall and the second end connected to the bottom wall.

10. The apparatus of claim 9, wherein the first end and the second end are positioned outside of the first zipper track and the second zipper track.

11. The apparatus of claim 1, wherein a zipper slider connects the first zipper track and the second zipper track beginning on the same point of the bottom wall.

12. A bag capable of collapsing into a smaller configuration, the bag comprising:

a top wall, a bottom wall, a front wall, a rear wall, a first side wall, and a second side wall, the walls coupled together to form the bag and the top wall provided with an opening to store articles;

a closure means formed on the top wall for providing access to the bag; and a zipper comprising a first zipper track and a second zipper track for facilitating the smaller configuration of the bag by joining the first zipper to the second zipper, wherein the first zipper track is formed on the bag beginning at a point of the bottom wall, which is located at a center position along the bottom wall, and extending substantially diagonal from the bottom wall along the rear wall to a first central end of the top wall where the first side wall and the first central end meet, the first zipper track continuing to extend from the top wall to the front wall to the bottom wall and to the rear wall and back to the top wall such that the first zipper track goes around a perimeter of the first side wall;

wherein the second zipper track is formed on the bag beginning at the point of the bottom wall and extending substantially diagonal from the bottom wall along the rear wall to a second central end of the top wall where the second side wall and the second central end meet, the second zipper track continuing to extend from the top wall to the front wall to the bottom wall to the rear wall and back to the top wall such that the second zipper track goes around a perimeter of the second side wall; and wherein the zipper further comprises a zipper slider for coupling the first zipper track and the second zipper track, wherein the bag collapses into the smaller configuration concealing the opening upon coupling of the first and the second zipper tracks, wherein the first zipper track and the second zipper track extend from the same point of the bottom wall.

13. The apparatus of claim 12, wherein the first sidewall, the second sidewall, the first zipper track, the second zipper track, and the zipper slider are exposed for viewing by the user while the top wall, the bottom wall, the front wall, the rear wall are concealed within the collapsed bag in the smaller configuration.

14. The apparatus of claim 12, further comprising a first handle coupled at a first end to the first sidewall and to a second end to the second sidewall, wherein coupling occurs outside the first zipper track and the second zipper track.

15. The apparatus of claim 14, wherein the first handle is exposed to a user.

16. A method for forming a collapsible bag that converts from a larger configuration to a smaller configuration, the method comprising:

providing a first sidewall and a second sidewall interconnected by a bottom wall, a front wall, a rear wall, and a top wall, the top wall comprising an opening to store articles;

disposing a first zipper track into the bottom wall, the first zipper track diagonally connecting between a point of the bottom wall, which is located at a center position along the bottom wall, and a first position, the first position proximally located between the first sidewall and the top wall, wherein the first zipper track continues to extend from the first position along a contour of the collapsible bag along the top wall, the front wall, the bottom wall, the rear wall back to the top wall; and disposing a second zipper track into the bottom wall opposite to the first zipper track, the second zipper track diagonally connecting between the point of the bottom wall and a second position, the second position proximally located between the second sidewall and the top wall, wherein the second zipper track continues to extend from the second position along the contour of the collapsible bag along the top wall, the front wall, the bottom wall, the rear wall and back to the top wall, wherein the first zipper track and the second zipper track are coupled to convert the collapsible bag from the larger configuration to the smaller configuration, the smaller configuration concealing the opening, wherein the first zipper track and the second zipper track extend from the same point of the bottom wall.

17. The method of claim 16, wherein a zipper slider connects the first zipper track and the second zipper track beginning on the same point of the bottom wall.

18. The method of claim 16, further comprising connecting a zipper slider between the first zipper track and the second zipper track for coupling of the first zipper track and the second zipper track along the contour of the collapsible bag to facilitate concealing the bottom wall, the front wall, the top wall, and the rear wall from the view of a user.

19. The apparatus of claim 12, wherein a zipper slider connects the first zipper track and the second zipper track beginning on the same point of the bottom wall.

* * * * *